US007517116B2

(12) United States Patent
Pfund

(10) Patent No.: US 7,517,116 B2
(45) Date of Patent: Apr. 14, 2009

(54) CONTOURED LENS FOR TASK AMBIENT LUMINAIRES

(75) Inventor: David Pfund, Woodbridge, CT (US)

(73) Assignee: Sylvan R. Shemitz Designs, Inc., West Haven, CT (US)

( * ) Notice: Subject to any disclaimer, the term of this patent is extended or adjusted under 35 U.S.C. 154(b) by 0 days.

(21) Appl. No.: 11/593,677

(22) Filed: Nov. 6, 2006

(65) Prior Publication Data

US 2007/0109631 A1 May 17, 2007

Related U.S. Application Data

(60) Provisional application No. 60/733,628, filed on Nov. 4, 2005.

(51) Int. Cl.
*F21V 5/00* (2006.01)

(52) U.S. Cl. ..... 362/334; 362/260; 362/319; 362/240

(58) Field of Classification Search ..... 362/223, 362/319, 326, 329, 330, 331, 334, 336, 337, 362/338, 351, 355, 361, 260, 270, 255, 217, 362/222, 133, 33, 97, 456
See application file for complete search history.

(56) References Cited

U.S. PATENT DOCUMENTS

| | | | | | |
|---|---|---|---|---|---|
| 1,941,079 | A | * | 12/1933 | Exelmans | 362/224 |
| 2,385,040 | A | * | 9/1945 | Hunter et al. | 362/223 |
| 3,159,352 | A | * | 12/1964 | Vick et al. | 362/222 |
| 3,647,148 | A | * | 3/1972 | Wince | 362/223 |
| 4,338,653 | A | * | 7/1982 | Marrero | 362/223 |
| 4,464,707 | A | * | 8/1984 | Forrest | 362/222 |
| 4,625,267 | A | * | 11/1986 | Mikalonis | 362/150 |
| 4,858,087 | A | * | 8/1989 | Hartshorn | 362/219 |
| 5,471,372 | A | * | 11/1995 | Mamelson et al. | 362/92 |

OTHER PUBLICATIONS

PCT Search Report—PCT/US06/43210.

* cited by examiner

*Primary Examiner*—Hargobind S Sawhney
(74) *Attorney, Agent, or Firm*—Cantor Colburn LLP

(57) ABSTRACT

A lens is provided for a task ambient luminaire having an elongated linear lamp tube for providing light, the lens including a refractive surface configured to extend along a portion of a length of the lamp and further configured to extend across the lamp in a direction substantially perpendicular to the length of the lamp, a mounting flange extending from the refractive surface and being configured to slidingly engage the luminaire and to support the lens within the luminaire, where the lens is slidably movable along the length of the lamp.

10 Claims, 4 Drawing Sheets

CONTOURED LENS FOR TASK AMBIENT LUMINAIRES

CROSS-REFERENCE TO RELATED APPLICATIONS

This application claims the benefit of U.S. Provisional Application 60/733,628 filed on 4 Nov. 2005, the contents of which are incorporated by reference herein in their entirety.

FIELD OF THE INVENTION

The disclosure relates generally to lighting fixtures and systems, and more particularly to a lens for a task ambient luminaire.

BACKGROUND OF THE INVENTION

Task ambient luminaires are generally understood to be lighting fixtures which provide light to both a defined target surface and to non-target specific area. Commonly, these type of luminaires are employed in an office context where light is required on a desk surface for task-specific applications and in a direction generally upward for casting light toward the ceiling and walls of the office space. Typically a task ambient luminaire used in the context includes a housing mounted on a wall or office partition above a work surface such as a desk. The housing includes one or more elongated linear lamp tubes and the required electrical components to mount and illuminate the lamp. The housing is further configured, by use of reflectors, etc., to direct light emitted from the lamp downward to the desk surface and upward to an ambient area comprising the ceiling and/or walls. Such task ambient constructions bring the light source closer to the task area and reduce or eliminate direct glare by hiding the lamp tube from view and by controlling the light with suitable lenses, refractors, reflectors, baffles, louvers and the like.

Refractor plates of specialized design are available which will reduce or eliminate both direct glare and reflected glare from a light source. Reflected glare is also known as veiling reflection and results from reflections from a task and the background of the task. For example, light-colored desk surfaces, writing paper thereon and light colored backgrounds reflect desirable light, but if the task (e.g., pencil or ink writing) also reflects light to the viewer, the contrast between the task and its immediate background is reduced. It is this reduction of contrast which makes seeing difficult.

Direct glare can be eliminated by baffles, shields, refractors and reflectors which cut off direct view of the lighting source. As for the elimination of veiling reflections, when their source is light emitted downward from a zone located above and slightly in front of the task area, refractor plates have been employed which refract or redirect the light. This refraction can be visualized in terms of the photometric curves showing relative candlepower distribution of the luminous flux. These curves take the form of a half bat wing shape, or a full bat wing shape if all of the luminous flux below and adjacent to the plane of the refractor is analyzed. The bat wing configurations represent luminous flux patterns and indicate the direction and distribution of the flux.

Typical of refractor plates which distribute luminous flux from a light source in a bat wing configuration are the plates described in U.S. Pat. Nos. 3,258,590 and 4,054,793. However, such reflectors are often fixed in place and offer the user little if no adjustability. Moreover, the mounting of the refractor plates in within the respective luminaires requires installation of fixation means within the luminaire such as mounting tabs on a housing portion of the luminaire and screw holes formed through luminaire reflectors. This type of fixation means complicates production and assembly of the luminaire and can degrade its performance by marring reflector surfaces etc. Addition, typical refractor plates are mounted in such a way as to interfere with the performance of the luminaire's reflectors. That is, refractor plates are often mounted beneath the respective lamp tube at some point upon the downlight luminaire reflector. In this situation, the mounting of the refractor plate impedes passage of light from the lamp tube through the luminaire housing to the task area below.

Thus, there is a need for a device which addresses the issue of veiling reflections caused by a task ambient luminaire, which is readily installed therein in such manner as to minimally interfere with desired light emanations of the luminaire lamp tube, and which is convenient to use and readily adjustable.

BRIEF DESCRIPTION OF THE INVENTION

Disclosed is a lens for a task ambient luminaire having an elongated linear lamp tube for providing light, the lens including a refractive surface configured to extend along a portion of a length of the lamp and further configured to extend across the lamp in a direction substantially perpendicular to the length of the lamp, a mounting flange extending from the refractive surface and being configured to slidingly engage the luminaire and to support the lens within the luminaire, where the lens is slidably movable along the length of the lamp.

Also disclosed is a lens for a task ambient luminaire having an elongated linear lamp tube for providing light, the lens including a refractive surface having a substantially semicircular cross section and a length less than a length of the lamp tube, and a first mounting flange extending radially from a first edge of the refractive surface, and a second mounting flange extending radially from an opposing second edge of the refractive surface, where the first and second mounting flanges are configured to hangingly engage the luminaire to support the lens within the luminaire, and where the lens is slidably movable along the length of the lamp.

Further disclosed is a task ambient luminaire including a housing configured to be mounted on a vertical surface, a downlight opening extending substantially along a longitudinal length of the housing, a linear lamp tube disposed in the housing proximate to the downlight opening and configured to emanate light through said opening, a downlight reflector disposed in the housing and extending along the lamp tube being configured to direct the light from the lamp tube through the downlight opening, and a lens having a refractive surface configured to extend along a portion of a length of the lamp and further configured to extend across the lamp in a direction substantially perpendicular to the length of the lamp, and a mounting flange extending from the refractive surface and being configured to slidingly engage the downlight reflector and to support the lens thereon within the luminaire, where the lens is slidably movable along the length of the lamp.

BRIEF DESCRIPTION OF THE FIGURES

The following descriptions should not be considered limiting in any way. With reference to the accompanying drawings, like elements are numbered alike.

DETAILED DESCRIPTION OF THE INVENTION

Figure 1:
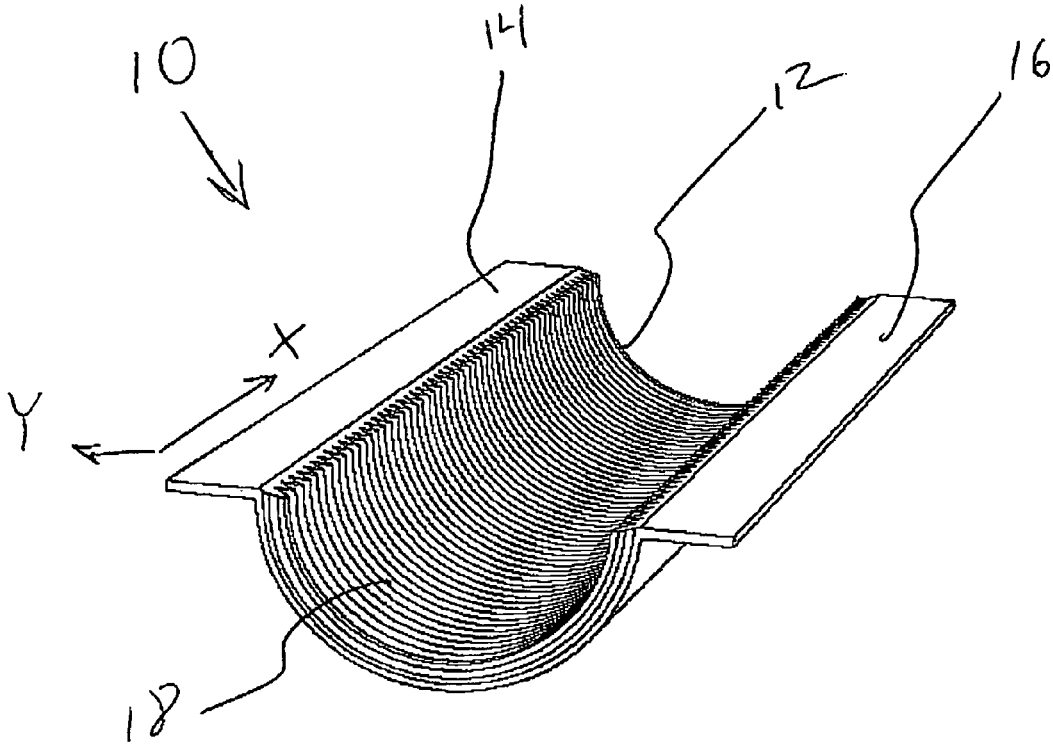
FIG. 1 is a perspective view of a contoured lens for a task ambient luminaire in one exemplary embodiment.
Figure 2:
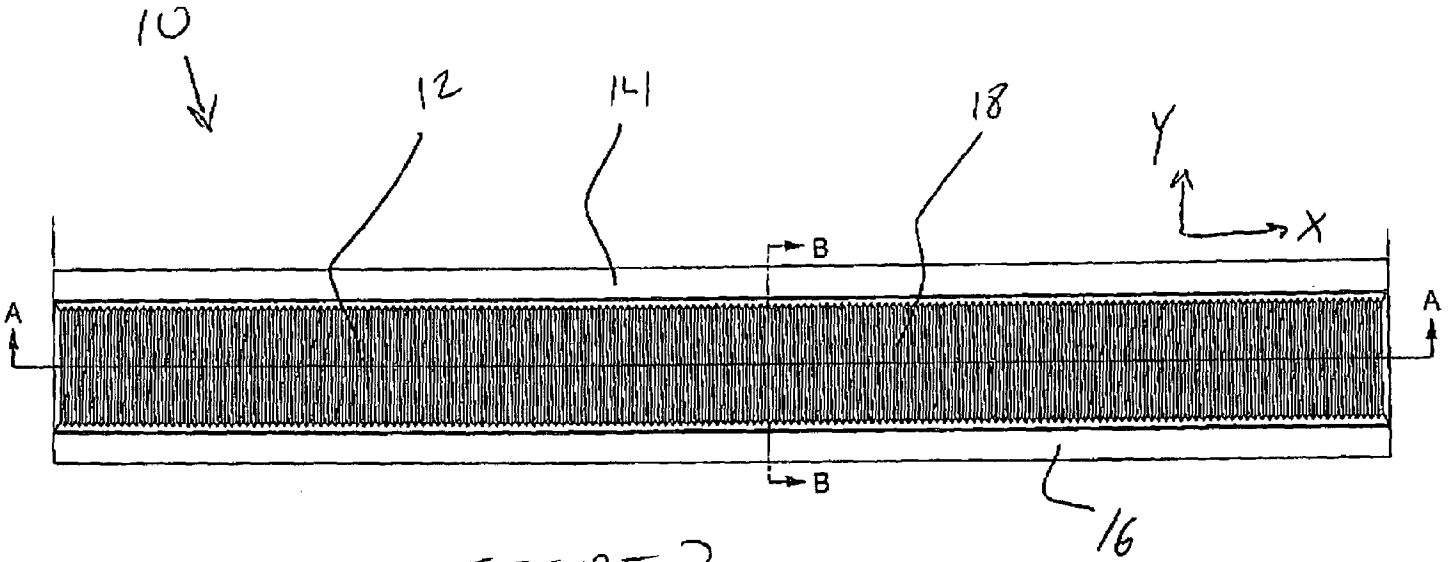
FIG. 2 is a top plan view thereof.
Figure 3:
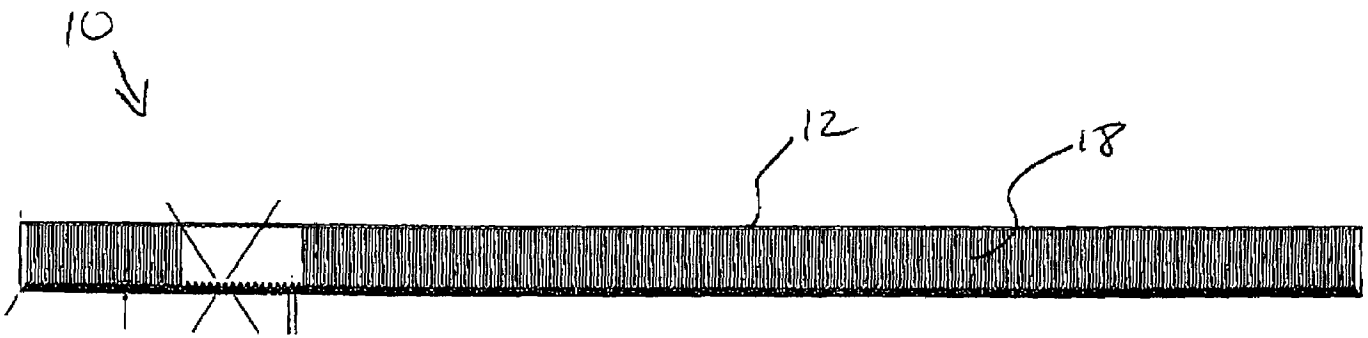
FIG. 3 is a cross-sectional view thereof.

FIG. 1 shows a contoured lens 10 in one exemplary embodiment. The lens 10 generally includes a refracting surface 12 extending between a first mounting flange and a second mounting flange 16. The refracting surface 12 includes contouring 18 formed thereon for refracting light from a source. In this example, the contouring 18 comprises a plurality of ridges extending between the opposed first and second mounting flanges 14 and 16. More particularly, the illustrative contouring 18 has a "saw-tooth" appearance when viewed in cross-section along a longitudinal axis of the lens 10. This "saw-tooth" arrangement may be seen in FIGS. 1-2 at the contouring 18 proximate to the first mounting flange 16 and in the cross-sectional view of FIG. 3. This linear prismatic interior surface of the lens 10 achieves a desirable "batwing" type task lighting distribution when the lens is used in conjunction with a linear light source, as discussed hereinbelow.

Figure 4:
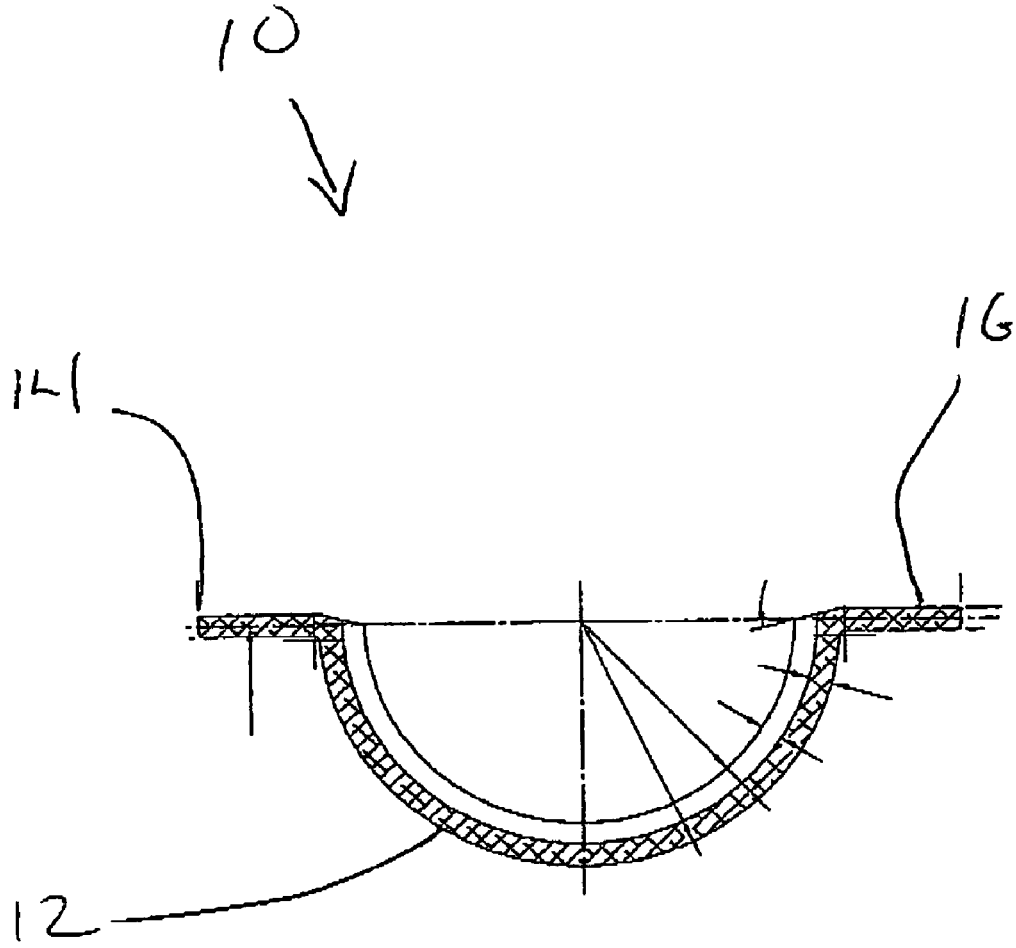
FIG. 4 is another cross-sectional view thereof.
Figure 5:
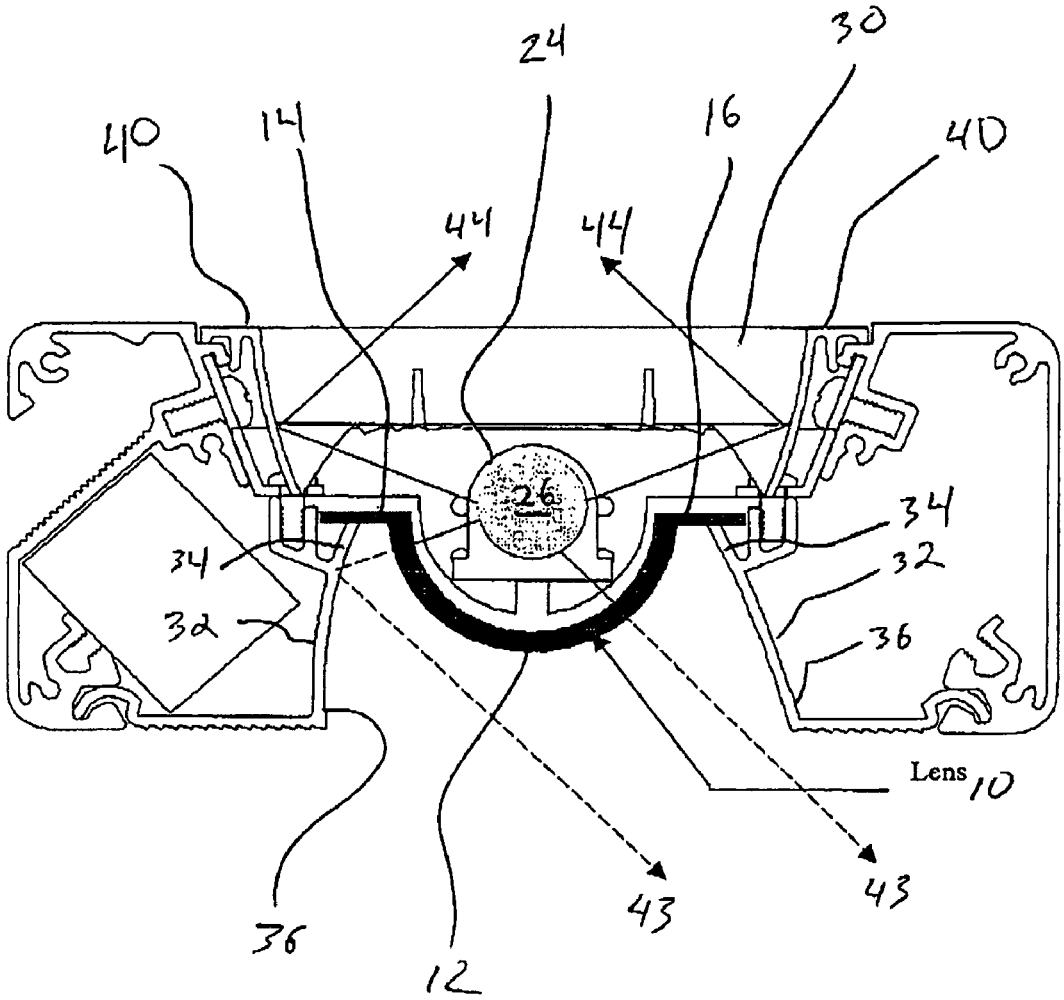
FIG. 5 is a cross-sectional view of a task ambient luminaire including the contoured lens of FIGS. 1-4.

In the present example, the refracting surface 12 is generally partially cylindrical in shape. That is, the refracting surface 12 includes a semi-circular cross-section as can be seen in FIGS. 1, 4, and 5. The first and second mounting flanges 14 and 16 extend in a direction X along a length of the contoured lens 10 and in a direction Y outwardly from the refracting surface 12 in radial fashion. The outward extension of the first and second mounting flanges 14 and 16 is generally perpendicular to the nearest portion of the reflective surface 12.

The contoured lens 10 is particularly configured to be readily disposed within a luminaire 20 as shown in FIG. 5. The luminaire 20 includes a housing 22 supporting a plurality of sockets 24 and an elongated linear lamp tube 24 installed in the sockets 24. The luminaire housing 22 further includes a downlight opening 28 delimited below the lamp 26 for allowing light emitted thereby to propagate downwardly toward a task surface (not shown). The housing 22 also includes a uplight opening 30 formed above the lamp 26 to allow light emitted thereby to propagate upwardly from the luminaire 20 toward a ceiling or walls, etc.

The luminaire housing 22 further includes one or more downlight reflectors 32 arranged beneath the lamp 26 proximate to the downlight opening 28 and configured to extend generally along a length of the lamp 26. The downlight reflectors 32 each have an upper edge 34 disposed proximate to the lamp 26 and a lower edge 36 disposed opposite from the first edge 34. The exemplary luminaire 20 additionally includes at least one uplight reflector 40 disposed above the lamp 26 and proximate to the uplight opening 30. Like the downlight reflectors 32, the uplight reflectors 40 extend generally along the length of the lamp 26.

The downlight and uplight reflectors 32 and 40 include a specular or semi-specular surface and are configured and positioned within the luminaire housing 22 to redirect light emitted from the lamp 26 in a desired downward or upward direction. For example, the downlight reflector 32 receives a light ray 42 and redirects the light ray 42 downwardly toward a task area. Similarly, the uplight reflectors 40 receive light rays 44 and redirect the rays 44 upwardly toward walls and/or a ceiling to provide ambient light above the luminaire 20.

The contoured lens 10 is disposed within the luminaire 20 at a position beneath the lamp 26. Particularly, the first and second mounting flanges 14 and 16 of the lens 10 are configured and disposed to engage the upper ends 36 of the downlight reflectors 32. That is, the first and second mounting flanges 14 and 16 contact the upper edges 34 of the downlight reflectors 32 such that the contoured lens 10 essentially hangs within the luminaire housing 22 from the downlight reflectors 32. The refractive surface 12 is shaped to traverse around the lamp 26 within the luminaire 20 as particularly shown in FIG. 5. That is, the semi-circular shape of the refractive surface 12 permits the lens 10 to be disposed proximate to the lamp 26 and to essentially encapsulate a lower portion of the lamp 26 without interfering with the lamp 26 in any manner. Importantly, the area above the lamp 26 remains open even when the lens 10 is installed within the luminaire 20 such that heat generated by the lamp 26 may rise naturally from the lamp 26, through the uplight opening 30, and exit the luminaire housing 22.

The contoured lens 10 is configured to be mounted within the luminaire housing 22 in such manner as to only minimally interfere with uplight and downlight emanations from the lamp 26. For example, downlight light rays 42 and 43 emitted from the lamp 26 pass through the refractive surface 12 without interfering with the mounting flanges 14 and 16. Particularly, the light ray 42 passes through the refractive surface 12 and is advantageously redirected toward the task area. The light ray 43 passes through the refractive surface 12 and proceeds directly to the task area. Similarly, the light rays 44 emanate from the lamp 26 and are redirected by the uplight reflectors 40 toward the ceiling and/or wall without being diminished by interference with the mounting flanges 14 and 16. In other words, the lens 10 is fashioned to be supported along two longitudinal edges occurring along the upper edge 34 of the luminaire downlight reflectors 32 and/or along a bottom edge of the luminaire uplight reflectors 40, thus causing any associated support features of the luminaire 20 to occur at points that least impact the distribution of light from the luminaire 20. Generally, these reflector edges occur neither above nor below the luminaire's lamp 26, but rather within the vertical dimension of the lamp 26.

Further advantageously, the semi-circular shape of the refractive surface 12 of the lens 10, as mentioned, essentially encapsulates a lower portion of the lamp 26. In this way, virtually all downlight emanations pass through the refractive surface and are augmented thereby prior to proceeding to the task area.

In the exemplary embodiment, the contoured lens 10 has a longitudinal length less than that of the lamp tube 26. For example, the lens 10 may have a longitudinal length of approximately 10 to 30 inches or for example approximately 18 inches. As described above, the lens 10 essentially hangs upon the downlight reflectors 32 without any type of permanent fixation means. This allows the lens 10 to slide along the upper edges 36 of the downlight reflectors 32. Accordingly, the user may advantageously adjust the positioning of the lens 10 along the length of the lamp tube 26 by simply sliding the lens 21 along the upper edges 34 of the downlight reflectors 32. This allows the user to position the lens 10 where desired. For example, the user may position the lens 10 precisely above a defined sub-area of the broader target task area in order to provide a specific and localized reflected glare reduction without unnecessarily limiting illumination of other areas of the broader task area. Another advantage of the adjustability of the lens 10 is a reduction in materials required for manufacture of the lens 10. That is, the lens adjustability allows for reflected glare reduction across the entire length of the lamp 26 without requiring the lens 10 to be as long as the lamp 26. This is because the lens 10, having a length shorter than that of the lamp 26, may be positioned where desired across the entire length of the lamp 26 to provide specific reflected glare reduction.

In an exemplary, non-limiting embodiment, the refraction surface 12 of the contoured lens 10 includes a semi-circle cross-section having an inner radius of approximately 0.75 inches and an outer radius of approximately 0.83 inches. The first and second mounting flanges 14 and 16 have a length in the Y direction of about 0.80 inches.

The lens 10 is described herein by way of example. Of course the many features, details, and dimensions of the lens 10 may vary in accordance with the broad scope of the invention.

For example, in another embodiment, the contoured lens may be configured to hang from a portion, such as a lip or flange, of the uplight reflectors. In such manner, the refractive surface still extends below the lamp and is adjustable along a length thereof. Alternatively, the lens 10 may be supported by a mounting feature, such as a lip or flange, of the luminaire housing.

In an alternate embodiment, the refractive surface 12 may include a curvilinear, non-circular cross-section. For example, the refractive surface 12 may include a elliptical and or parabolic cross-section. In still another embodiment, the refractive surface 12 may include a rectilinear cross-section. For example, the refractive surface 12 may include a triangular, V-shape, square, and/or rectangular cross-section, etc.

In another embodiment of the invention, the lens may include only one mounting flange which is configured and disposed to sufficiently support the refractive surface.

In still another exemplary embodiment, the lens may extend the entire length of the lamp.

Additionally and/or alternatively, the lens may be disposed on the upper side of the lamp to reduce glare in the uplight portion of the luminaire.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A lens for a task ambient luminaire having an elongated linear lamp tube for providing light, the lens comprising:

a refractive surface configured to extend along a portion of a length of the lamp and further configured to extend across the lamp in a direction substantially perpendicular to the length of the lamp; and a mounting flange extending from the refractive surface and being configured to slidingly engage the luminaire and to support the lens within the luminaire;

wherein the lens is slidably movable along the length of the lamp, wherein the first and second mounting flanges are configured and disposed to slidingly engage first and second reflectors of the luminaire at sides of the lamp tube such that upward and downward emanations of the lamp generally avoid the first and second mounting flanges.

2. The lens of claim 1, wherein the refractive surface comprises saw-tooth contouring extending in a direction substantially perpendicular to the length of the lamp.

3. The lens of claim 1, wherein the refractive surface includes a curved cross-section configured to partially surround a cross-section of the lamp tube.

4. The lens of claim 3, wherein the refractive surface surrounds a lower half of the cross-section of the lamp tube.

5. The lens of claim 1, wherein the mounting flange extends along substantially an entire length of the refractive surface, wherein the refractive surface has a semi-circular cross-section which extends in a direction opposite from the mounting flange.

6. The lens of claim 1, wherein the mounting flange comprises a first mounting flange disposed on a first side of the refractive surface and a second mounting flange disposed on an opposite second side of the refractive surface.

7. The lens of claim 6, wherein the refractive surface is substantially semi-circular in cross-section and wherein the first and second mounting flanges extend in a first direction radially from the refractive surface and in a second direction along a length of the refractive surface.

8. The lens of claim 1, wherein the first reflector extends the length of the lamp tube on one side of the lamp tube and wherein the second reflector extends the length of the lamp tube on a second side of the lamp tube and wherein the first and second mounting flanges enable the lens to be slidingly positioned at any point along the first and second reflectors.

9. A lens for a task ambient luminaire having an elongated linear lamp tube for providing light, the lens comprising:

a refractive surface having a substantially semi-circular cross section and a length less than a length of the lamp tube; and a first mounting flange extending radially from a first edge of the refractive surface; and a second mounting flange extending radially from an opposing second edge of the refractive surface;

wherein the first and second mounting flanges are configured to hangingly engage the luminaire to support the lens within the luminaire; and wherein the lens is slidably movable along the length of the lamp.

10. The lens of claim 9, wherein the refractive surface includes contouring having a saw-toothed cross-section and wherein the first and second mounting flanges are disposed to engage and hang upon upper edges of two respective reflectors disposed within the luminaire extending along the length of the lamp tube.

* * * * *